US005990617A

United States Patent [19]

Kanae et al.

[11] Patent Number: 5,990,617

[45] Date of Patent: Nov. 23, 1999

[54] PLASMA DISPLAY PANEL AND METHOD OF FORMING BARRIER RIBS FOR THE SAME

[75] Inventors: Tatsutoshi Kanae; Masayuki Shiraishi, both of Kanagawa, Japan

[73] Assignee: Fujitsu Limited, Kawasaki, Japan

[21] Appl. No.: 08/754,314

[22] Filed: Nov. 21, 1996

[30] Foreign Application Priority Data

Jul. 11, 1996 [JP] Japan ..... 8-182402

[51] Int. Cl.[6] ..... H01J 9/24

[52] U.S. Cl. ..... 313/582; 313/586

[58] Field of Search ..... 313/582–587; 445/24

[56] References Cited

U.S. PATENT DOCUMENTS 5,428,263 6/1995 Nagano ..... 313/585

5,860,843 1/1999 Kasahara ..... 445/24

FOREIGN PATENT DOCUMENTS 458438 2/1992 Japan .

4249828 9/1992 Japan .

*Primary Examiner*—Kenneth J. Ramsey

*Attorney, Agent, or Firm*—Greer, Burns & Crain, Ltd.

[57] ABSTRACT

A method of formimg barrier ribs for a plasma display panel including the steps of: roughening a barrier rib formation surface of a substrate; forming a barrier rib material layer on the roughened barrier rib formation surface; and forming, on the barrier rib material layer, a mask having a pattern corresponding to the barrier ribs to be formed. In addition, forming the ribs includes partially removing the barrier rib material layer by blasting an abrasive against the barrier rib material layer to form the barrier ribs below the mask. Removing the mask reveals barrier ribs for partitioning a discharge space formed on the substrate.

16 Claims, 5 Drawing Sheets

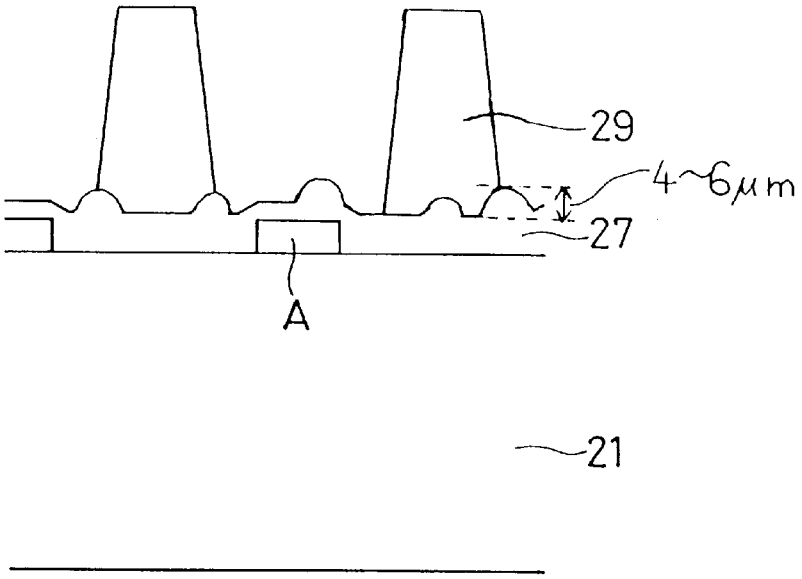
Fig. 2 (a)
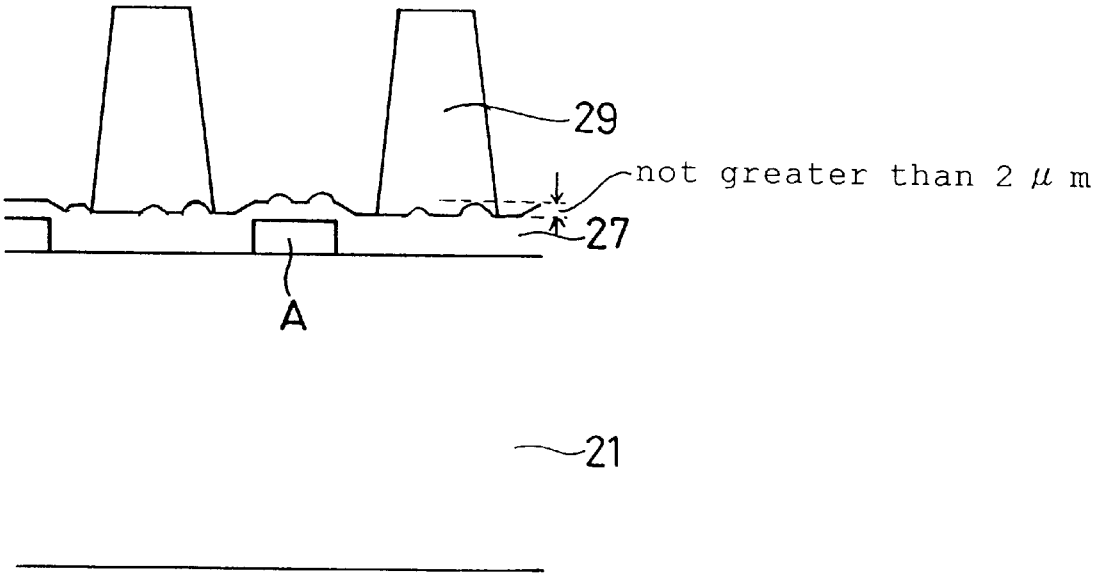
Fig. 2 (b) (Prior Art)

PLASMA DISPLAY PANEL AND METHOD OF FORMING BARRIER RIBS FOR THE SAME

BACKGROUND OF THE INVENTION

1. Field of the Invention

The present invention relates to a plasma display panel and a method of forming barrier ribs for the same. More particularly, the invention relates to a plasma display panel and a method of forming barrier ribs for the same, which can prevent the separation of the barrier ribs.

2. Related Art

Recently, there have been increasingly demanded display devices having a reduced thickness and a larger display area. Among a variety of display devices, plasma display panels (hereinafter referred to as "PDPs") have a reduced thickness and are readily adapted for color display and for a larger display area. In addition, the PDPs are self-luminant and have excellent visibility. Therefore, the PDPs are promising, for example, as wall-mount large-screen TVs (Japanese Unexamined Patent Publications No.3-179630(1991), No.5-299019(1993) and 7-161298(1995).

The PDP is a display device which has a discharge space defined between a pair of substrates opposed to each other with a minute spacing and are peripherally sealed.

The PDP typically has barrier ribs formed on one of the substrates for partitioning the discharge space. In the case of a PDP adapted for color display, for example, elongated barrier ribs are formed on a substrate in an equidistantly spaced relation, and fluorescent layers are provided between the barrier ribs.

The formation of the barrier ribs are typically achieved by applying a glass paste onto the substrate by way of screen printing and then baking the resulting substrate. However, this method presents difficulties associated with reduction in the barrier rib width and arrangement pitch, so that a high-precision display cannot be realized. In an attempt to increase the size of the display area, contraction of a screen mask makes it impossible to maintain a uniform positional relationship between electrodes and the barrier ribs over the entire display area. Overprinting is required to be performed ten times or so for the formation of the barrier ribs having a predetermined height. This leads to deformation of the barrier ribs at the printing and at the baking, which may cause a discharge failure.

As an alternative to the screen printing method, a sandblast method has been proposed for practical applications. In accordance with this method, a barrier rib material layer is formed on a barrier rib formation surface of a substrate, and then a mask having a predetermined barrier rib pattern is formed thereon by photolithography. Thereafter, the barrier rib material layer is selectively removed for formation of barrier ribs below the mask by blasting an abrasive perpendicularly to the barrier rib material layer, and then the mask is removed.

Where barrier ribs having a smaller width are formed by the sandblast method, the barrier ribs are liable to separate from the substrate when the mask is removed or due to an external force such as vibration applied when the substrate is combined with a counter substrate for assembly of a display panel.

SUMMARY OF THE INVENTION

As a result of intensive studies, the inventors of the present invention have found that the aforesaid problems can be overcome by allowing the barrier ribs to have a greater adhesive strength to the substrate than to the mask, and achieved the present invention.

In accordance with a first aspect of the present invention, there is provided a method of forming barrier ribs for a plasma display panel comprising the steps of:

roughening a barrier rib formation surface of a substrate;

forming a barrier rib material layer on the roughened barrier rib formation surface;

forming on the barrier rib material layer a mask having a pattern corresponding to the barrier ribs to be formed;

partially removing the barrier rib material layer by blasting an abrasive against the barrier rib material layer to form the barrier ribs below the mask; and removing the mask, thereby barrier ribs for partitioning a discharge space form on the substrate.

In accordance with a second aspect of the present invention, there is provided a barrier rib formation method for a plasma display panel comprising the steps of:

forming a dielectric layer for covering a surface of a substrate formed with a plurality of electrodes;

roughening a surface of the dielectric layer;

forming a barrier rib material layer on the roughened surface of the dielectric layer;

forming on the barrier rib material layer a mask having a pattern corresponding to barrier ribs to be formed;

partially removing the barrier rib material layer by blasting an abrasive against the barrier rib material layer to form the barrier ribs below the mask; and removing the mask, thereby barrier ribs for partitioning a discharge space form on the substrate.

In accordance with a third aspect of the present invention, there is provided a plasma display panel comprising:

a plurality of electrodes formed on a surface of a substrate;

a dielectric layer covering the electrodes and having a microscopically undulated surface with a surface roughness of 4 $\mu$m to 6 $\mu$m; and the barrier ribs having a predetermined pattern and being formed for partitioning a discharge space such that walls thereof extend generally perpendicular to the surface of the substrate, by forming a barrier rib material layer on the surface of the dielectric layer, covering the barrier rib material layer with a mask having a predetermined pattern, and removing a portion of the barrier rib material layer exposed from the mask by sandblasting.

BRIEF DESCRIPTION OF THE DRAWINGS

FIGS. 2(*a*) and 2(*b*) are schematic sectional views illustrating barrier ribs formed in accordance with the present invention and the prior art, respectively;

DESCRIPTION OF THE PREFERRED EMBODIMENTS

Figure 1:
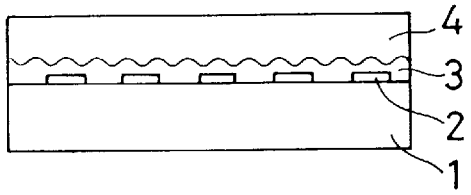
FIGS. 1(*a*) to 1(*f*) are sectional process diagrams schematically illustrating a barrier rib formation method for a plasma display panel in accordance with the present invention.
Figure 1:
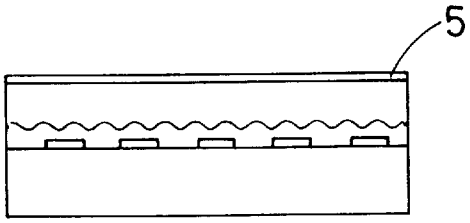
Figure 1:
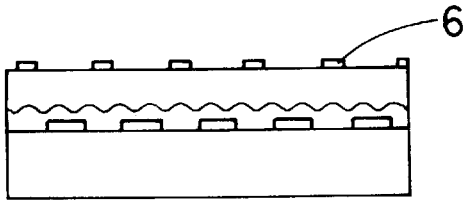
Figure 1:
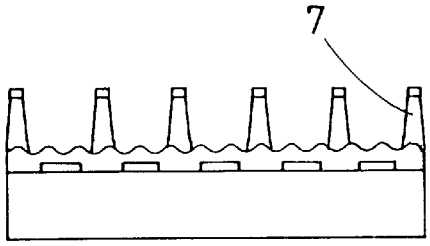
Figure 1:
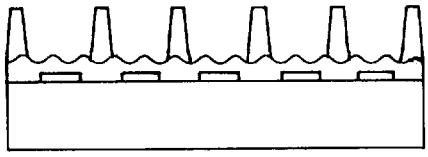
Figure 1:
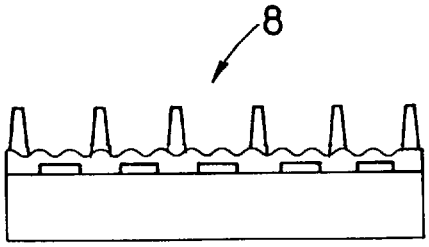

A barrier rib formation surface of a substrate is herein defined as a surface of a passivation film formed between a surface of an insulative substrate and electrodes, as a surface of the dielectric layer for insulating the electrodes from a discharge space, or as a surface of a cutting-preventive film for protecting the electrodes and the insulative substrate from being sandblasted. Examples of the insulative substrate include a glass substrate and a quartz substrate, among which the glass substrate is preferred because of its inexpensiveness. The dielectric layer will hereinafter be described with an AC-driven tri-electrode surface discharge PDP used as an example.

A plurality of linear address electrodes are formed in a predetermined spaced-apart relation on a rear insulative substrate. Materials to be used for the address electrodes are not particularly limited, but known electrode materials may be used. Examples thereof include Ag, Au, Al, Cu and Cr, laminates formed of any of these metals, and metal oxides such as ITO, among which Ag or a three-layer structure of Cr/Cu/Cr is preferred. Preferably, the address electrodes have a thickness of 1 $\mu$m to 1.5 $\mu$m and a width of 50 $\mu$m to 100 $\mu$m, and are formed with a pitch of 200 $\mu$m to 400 $\mu$m.

The barrier rib formation surface is roughened. The roughened surface is preferably a microscopically undulated surface having a surface roughness of 4 $\mu$m to 6 $\mu$m.

Exemplary methods for imparting the aforesaid roughness to the surface of the insulative substrate include physical methods such as sandblasting, and chemical methods such as etching. In the sandblasting method, an abrasive, such as particles of calcium carbonate or glass beads having particle sizes of 10 $\mu$m to 30 $\mu$m, is blasted against the surface of the insulative substrate with a pressure of about 1.5 Kg/cm$^2$ to about 3 Kg/cm$^2$ for 5 to 15 minutes for imparting the insulative substrate with the aforesaid roughness. An exemplary chemical etching method is a wet etching process in which the insulative substrate is immersed in an etchant such as of hydrofluoric acid for 1 to 10 minutes (which depends on the type of an etchant to be used).

For imparting the aforesaid roughness to the surface of the dielectric layer formed on the insulative substrate, (1) the dielectric layer is formed of a dielectric material at apredetermined temperature, or (2) the dielectric layer is formed of a dielectric material blended with fillers having predetermined particle diameters at apredetermined temperature. In either case, the dielectric material is applied to a thickness of 10 $\mu$m to 20 $\mu$m, which is reduced to half in a subsequent baking process.

In the former case (1), the material for the dielectric layer is not particularly limited, but known dielectric materials may be used. An exemplary material is a low melting point glass paste comprising low melting point glass powder and a resin binder (ethyl cellulose or the like) . The low melting point herein means a temperature lower than 600° C. The low melting point glass paste is applied onto the substrate by a known method, and baked at a temperature lower by about 10 to 20° C. than a vitrification point of the low melting point glass powder. Thus, the dielectric layer having the aforesaid surface roughness is formed. More specifically, the baking temperature ranges from about 560° C. to about 570° C. If the baking temperature is substantially lower than 560° C., the dielectric layer becomes porous, so that a multiplicity of pores extend through the dielectric layer in a depthwise direction. As a discharge gas filled inapanel (discharge space) gradually leaks through the pores, the discharge gas decreases. That is, the porous dielectric layer causes slow leak, resulting in an illumination failure. A baking temperature of substantially higher than 570° C. is not preferable, because the surface roughness is decreased.

In the latter case (2), the aforesaid glass paste is blended with fillers having predetermined particle diameters, then applied onto the substrate by a known method, and baked for the formation of the dielectric layer.

The paste to be used preferably contains (a) fillers having a mean particle diameter of 1.5 $\mu$m to 5 $\mu$m (more preferably 1.5 $\mu$m to 3 $\mu$m) and free from particles having particle diameters of not greater than 1 $\mu$m in a proportion of 6% to 18% by weight (more preferably 10% to 15% by weight), or (b) fillers having a mean particle diameter of 4 $\mu$m to 10 $\mu$m (more preferably 4 $\mu$m to 6 $\mu$m) in a proportion of 10% to 35% by weight (more preferably 15% to 25% by weight).

The pastes (a) and (b) provide the dielectric layer with a predetermined surface roughness (preferably 4 $\mu$m to 6 $\mu$m) in which the fillers are partially exposed to the surface of the dielectric layer by the baking thereof.

The baking temperature is preferably about 575° C. to about 595° C. If the baking temperature is substantially lower than 575° C., the baking may be insufficient. If the baking temperature is substantially higher than 595° C., blisters (crater-like protuberances) are produced so that barrier ribs cannot properly be formed and the dielectric layer cannot be formed to a predetermined thickness. Since the viscosity of the paste becomes lower with the increase in the baking temperature, a higher baking temperature reduces the effects of the blending of the fillers. Therefore, a more preferable baking temperature is in a range between about 575° C. and about 580° C.

A solvent (terpineol or the like) may be added to the low melting point glass paste for adjusting the viscosity of the paste to a level suitable for the application thereof.

In turn, the barrier ribs are formed on the barrier rib formation surface having the predetermined surface roughness (preferably 4 $\mu$m to 6 $\mu$m). If the surface roughness is out of the range between 4 $\mu$m and 6 $\mu$m, anchoring effects by an increased contact area cannot be expected. A surface roughness of 4.5 $\mu$m to 5.5 $\mu$m is more preferable.

More specifically, a barrier rib material layer is formed on the barrier rib formation surface, and then a mask having a pattern corresponding to the barrier ribs to be formed is formed on the barrier rib material layer. In turn, the barrier rib material layer is selectively removed by sandblasting. Thus, the barrier ribs are formed below the mask, which is thereafter removed.

The barrier rib material is not particularly limited, but known barrier rib materials may be used. An exemplary barrier rib material is a low melting point glass paste comprising a low melting point glass and a resin binder and diluted with a solvent to a viscosity suitable for the application thereof. Examples of the resin contained in the low melting point glass paste include cellulosic resins such as ethyl cellulose. The barrier rib material layer preferably has a thickness of 150 $\mu$m to 250 $\mu$m. The formation of the barrier rib material layer is achieved by any known application method.

The barrier rib material layer may comprise a first barrier rib material layer containing 2 wt % to 4 wt % of a cellulosic resin and a second barrier rib material layer containing 1 wt % to 2 wt % of a cellulosic resin formed on the first barrier rib material layer. The first and second barrier rib material layers preferably have a thickness ratio of 13:1 to 15:1. The resin contained in the first barrier rib material layer is carbonized at the baking to increase the adhesive strength of the barrier rib material layer to the barrier rib formation surface. The second barrier rib material layer serves for easy processing by sandblasting as described below.

For formation of the mask on the barrier rib material layer, a dry film resist is stuck on the barrier rib material layer, then exposed and developed. Alternatively, a resist solution is applied on the barrier rib material layer, then exposed and developed; or a resist solution is screen-printed on the barrier rib material layer.

In turn, the barrier rib material layer is selectively removed by sandblasting so that a portion of the barrier rib material layer is left below the mask. In the sandblasting method, the abrasive such as particles of calcium carbonate or silicon carbide or glass beads having particle sizes of 10 $\mu$m to 30 $\mu$m are preferably blasted against the barrier rib material layer with a pressure of about 1.5 Kg/cm$^2$ to about 3 Kg/cm$^2$ for 15 to 30 minutes.

Subsequently, the mask is removed (peeled off). Preferably used as a solution for peeling off the mask is a weak alkaline aqueous solution containing 0.1 wt % to 1.0 wt % of sodium carbonate. The use of this solution more effectively prevents the separation of the barrier ribs from the barrier rib formation surface in comparison with a sodium hydroxide solution conventionally used. The removal of the mask is achieved by a known method such as immersion or spraying.

The resulting substrate is baked at about 560° C. for formation of a substrate structure having the barrier ribs. The barrier ribs have a height of about 100 $\mu$m to about 200 $\mu$m after the baking.

The barrier rib formation method according to the present invention can be applied not only to PDPs (of AC type and DC type) but also to active matrix liquid crystal display device in which a liquid crystal layer is stacked on a gas discharge layer which is used as a switching element.

There will next be described barrier rib formation methods for PDPs.

EXAMPLES

The present invention will hereinafter be described by way of examples in which the same is applied to an AC-driven tri-electrode surface discharge PDP.

The general construction of the surface discharge PDP will first be explained with reference to FIGS. 3, 4 and 5 in which a perspective view and sectional views of the PDP are shown, respectively.

A pair of sustain electrodes (also referred to as device electrodes) X and Y are formed for each matrix display line L on an interior surface of a front glass substrate 11. The sustain electrodes X and Y each include a transparent electrode 41 and a metal electrode (bus electrode) 42, and are covered with a dielectric layer 17 for AC driving. A protective film 18 of MgO is formed on a surface of the dielectric layer 17 by vapor deposition.

Provided on an interior surface of a rear glass substrate 21 are address electrodes A, a dielectric layer 27, barrier ribs 29 and fluorescent layers 28 of three colors (R, G, B) . The barrier ribs 29 each have a linear configuration in plan. The barrier ribs 29 partition a discharge space 30 along a line of the matrix display to define respective subpixels, and define the discharge space 30 as having a predetermined gap. Each pixel (picture element) for display comprises three subpixels arranged along the line. The subpixel each comprises a combination of an address discharge cell formed at an intersection of an address electrode A and a sustain electrode Y and a display discharge cell formed between of sustain electrodes X and Y. In the PDP, the barrier ribs 29 are arranged in a so-called stripe pattern and, therefore, the subpixels in each row in the discharge space 30 are arranged in sequence across all the lines L. The subpixels in each row are adapted to emit the same color light.

Figure 3:
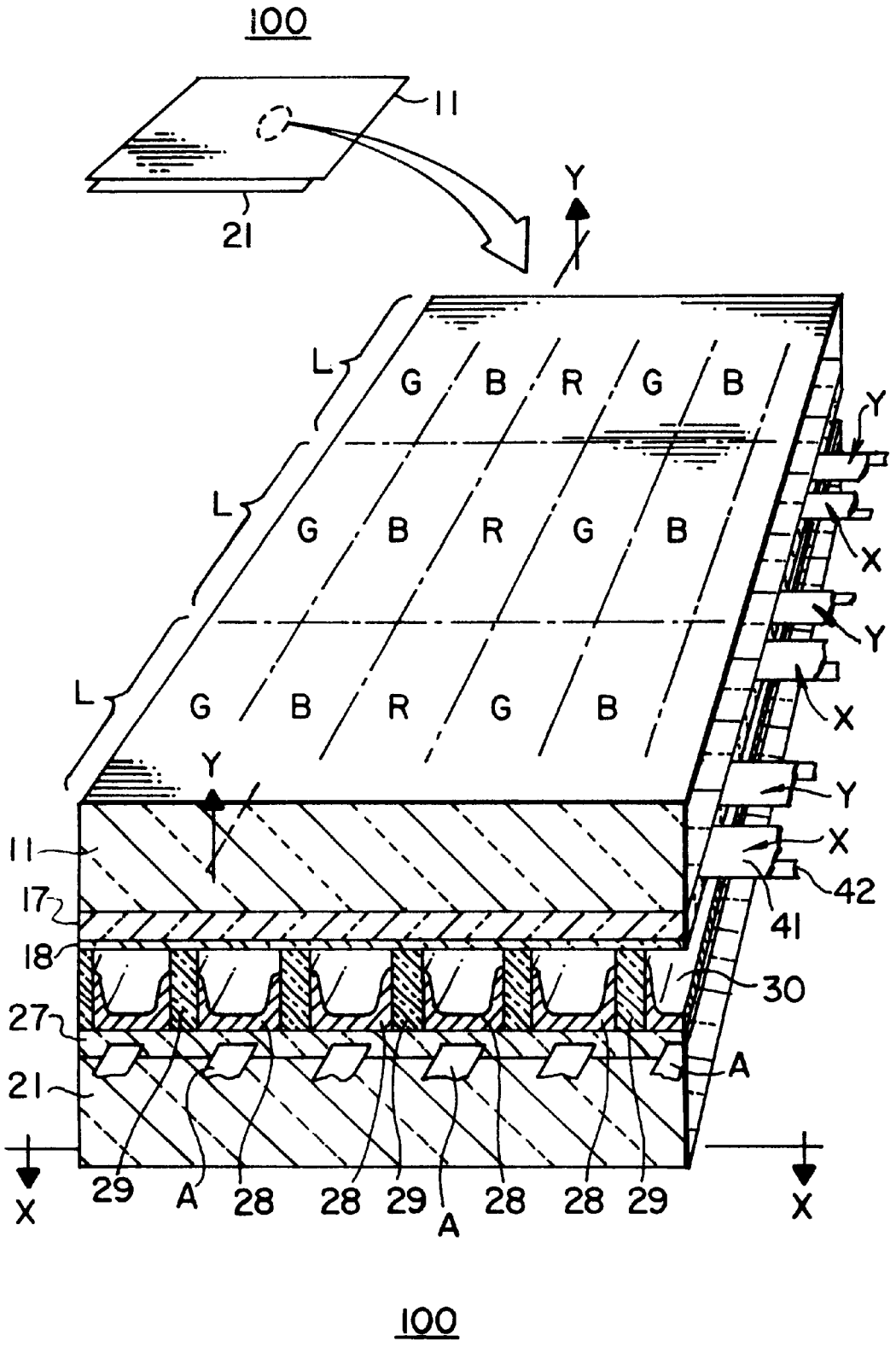
FIG. 3 is a schematic perspective view illustrating an AC-driven tri-electrode surface discharge PDP which is applied to the present invention.
Figure 4:
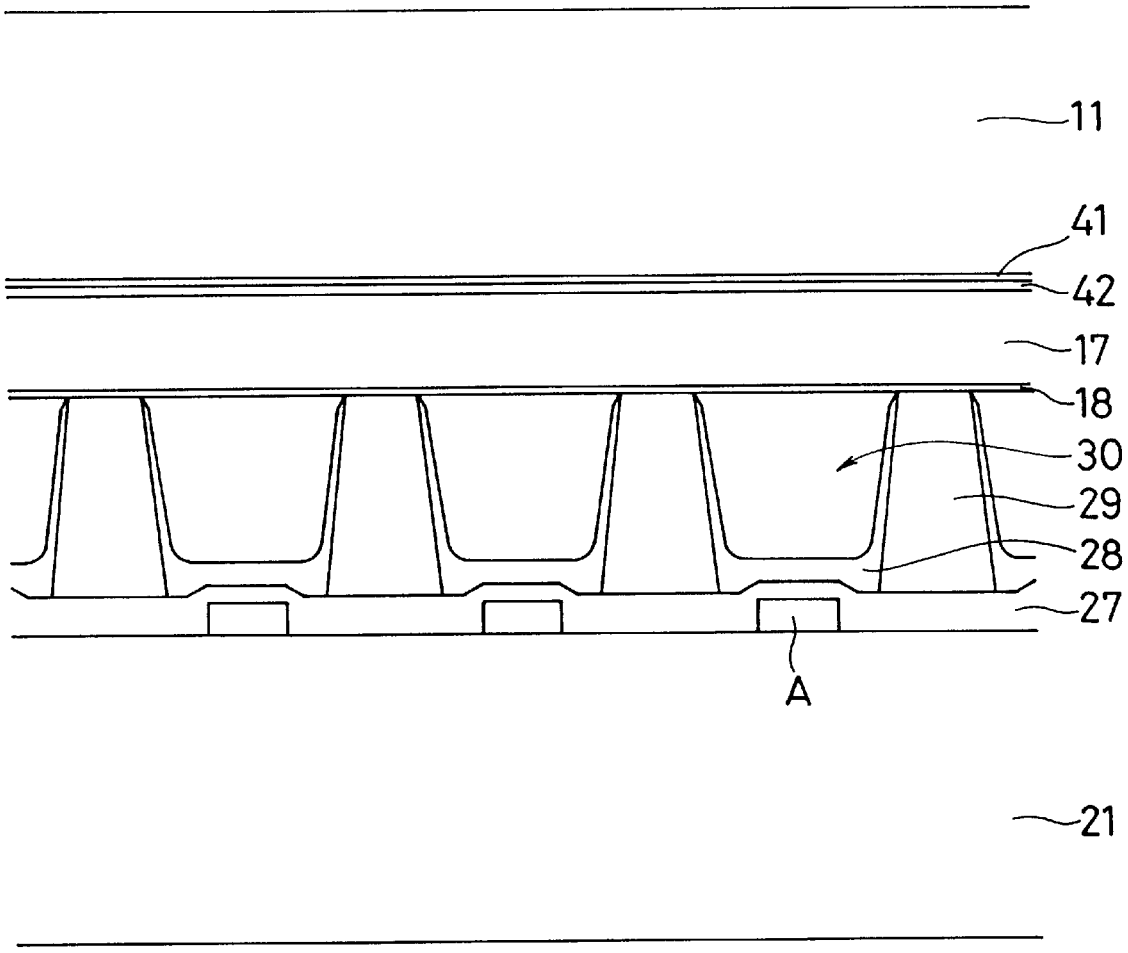
FIG. 4 is a schematic sectional view taken along a line X—X of FIG. 3.
Figure 5:
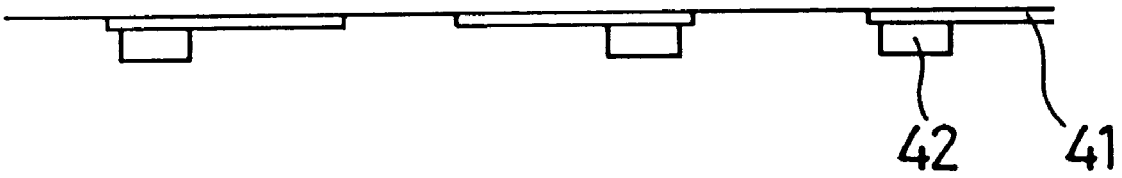
FIG. 5 is a schematic sectional view taken along a line Y—Y of neighboring transparent electrodes and bus electrodes of FIG. 3.

It is noted that FIG. 4 is a sectional view taken along a line X—X of FIG. 3 and FIG. 5 is a sectional view taken along a line Y—Y of a front substrate structure in FIG. 3.

An explanation will next be given to methods of forming barrier ribs on a rear substrate in accordance with the present invention.

EXAMPLE 1 AND COMPARATIVE EXAMPLE 1

Cr, Cu and Cr were vapor-deposited in this order to thicknesses of 1,000 Å, 10,000 Å and 2,000 Å, respectively, on a glass substrate 1. Then, the Cr/Cu/Cr layers were patterned by a known photolithography technique to form address electrodes 2 each having a width of 70 $\mu$m with a pitch of 120 $\mu$m.

A low melting point glass paste containing fillers of $Al_2O_3$ having a mean particle diameter, a maximum particle diameter and a content as shown in Table 1 (free from particles having particle diameters of not greater than 1 $\mu$m in Example 1), a low melting point glass, a resin and a solvent of terpineol was applied to a thickness of 15 $\mu$m on the resulting substrate. In turn, the substrate was baked at 575° C. for 10 minutes for formation of a dielectric layer 3. In Example 1, the dielectric layer had a microscopically undulated surface of a surface roughness of 4 $\mu$m to 6 $\mu$m as shown in FIG. 2(*a*). In Comparative Example 1, the dielectric layer had a microscopically undulated surface of a surface roughness of not greater than 2 $\mu$m as shown in FIG. 2(*b*). The dielectric layers were vitrified.

In turn, the low melting point glass paste was applied to a thickness of 180 $\mu$m on the dielectric layer 3 for formation of a barrier rib material layer 4 (see FIG. 1 (*a*)) . A dry film 5 including a resin binder of an acrylic polymer containing methyl methacrylate was applied onto the resulting substrate (see FIG. 1 (*b*)) . Then, a mask 6 was formed on the barrier rib material layer to cover portions thereof between the address electrodes by exposing and developing the dry film (see FIG. 1(*c*)).

Subsequently, calcium carbonate particles having particle sizes of 10 $\mu$m to 30 $\mu$m were blasted against the barrier rib material layer with a pressure of about 2.2 Kg/cm$^2$ for 20 minutes (sandblasting method). By the sandblasting method, portions of the barrier rib material layer not covered with the mask were removed. Thus, barrier ribs 7 having a width of 70 $\mu$m and a height of 180 $\mu$m were formed with a pitch of 220 $\mu$m (see FIG. 1(*d*)).

In turn, an aqueous solution containing 0.5 wt % to 2.0 wt % of sodium carbonate was sprayed onto the resulting substrate with a pressure of 0.5 Kgf/cm$^2$ to 3.0 Kgf/cm$^2$ for 3 to 8 minutes, and then pure water with a pressure of 0.5 Kgf/cm$^2$ to 3.0 Kgf/cm$^2$ for 2 to 12 minutes for removal of the mask 6 (see FIG. 1(*e*)).

Thereafter, the resulting substrate was baked at 560° C. Thus, a rear substrate structure 8 was obtained (see FIG. 1(*f*)). The results are shown in Table 1.

TABLE 1

| | Ex. 1 | | Com. Ex. 1 | |
|---|---|---|---|---|
| Fillers | A | B | A | B |
| Mean particle diameter | 5 μm | 1.5 μm | 2.5 μm | 1.5 μm |
| Maximum particle diameter | 15 μm | 5.5 μm | 15 μm | 5.5 μm |
| Content | 6 wt % | 18 wt % | 8 wt % | 6 wt % |
| Surface roughness | 4–6 μm | | not greater than 2 μm | |
| Evaluation | OK | | NG | |

In Table 1, "NG" means that 5% to 30% of the barrier ribs were peeled off, and "OK" means that the barrier ribs were substantially free from the peel off (hereinafter the same).

Table 1 shows that an effective range of the surface roughness is between 4 μm and 6 μm. As can be understood, the method according to Example 1 can prevent the separation of the barrier ribs during the removal of the mask. Further, the method can prevent the separation of the barrier ribs which may otherwise be caused due to vibration or the like when the rear substrate structure is combined with a counterpart front substrate structure. In addition, since the dielectric layer is vitrified, the slow leak of a discharge gas can be prevented.

EXAMPLES 2 TO 4 AND COMPARATIVE EXAMPLES 2 AND 3

In these examples, rear substrate structures were fabricated in substantially the same manner as in Example 1, except that the dielectric layer was not formed on the address electrodes but the surface of the substrate was subjected to a surface roughening process as described below.

(1) The surface of the substrate was roughened by a sandblasting method in which calcium carbonate particles having particle sizes of 10 μm to 30 μm were blasted against the surface of the substrate with a pressure of about 2.2 $Kg/cm^2$ for 5 to 15 minutes (Example 2).

(2) The surface of the substrate was roughened by an etching method in which the substrate was immersed in a hydrofluoric acid based etchant for 1 to 10 minutes (Examples 3 and 4, and Comparative Example 3).

A substrate including a substrate subjected to neither of these surface roughening processes was fabricated for comparison (Comparative Example 2).

The results are shown in Table 2.

TABLE 2

| | Surface roughness | Evaluation |
|---|---|---|
| Com. Ex. 2 | not greater than 1 μm | NG |
| Ex. 2 | about 4 μm | OK |
| Ex. 3 | about 5 μm | OK |
| Ex. 4 | about 4 μm | OK |
| Com. Ex. 3 | about 3 μm | NG |

Table 2 shows that the separation of the barrier ribs can be prevented by subjecting the substrate to the surface roughening process.

EXAMPLES 5 AND 6 AND COMPARATIVE EXAMPLES 4 TO 7

Rear substrate structures were fabricated in substantially the same manner as in Example 1, except that a low melting point glass paste containing fillers having substantially the same particle size distribution as in the prior art was used and various baking temperatures were employed. The results are shown in Table 3.

TABLE 3

| | Baking temperature | Retention time | Surface roughness | Evaluation | Note |
|---|---|---|---|---|---|
| Com.Ex.4 | 530° C. | 10 min. | about 9 μm | NG | *1 |
| Com.Ex.5 | 540° C. | 10 min. | about 8 μm | NG | *1 |
| Com.Ex.6 | 550° C. | 10 min. | about 7 μm | NG | *1 |
| Ex.5 | 560° C. | 10 min. | about 6 μm | OK | |
| Ex.6 | 570° C. | 10 min. | about 4 μm | OK | |
| Com.Ex.7 | 580° C. | 10 min. | about 2 μm | NG | *2 |

*1 Lack of strength of dielectric layer.
*2 Lack of adhesive strength between dielectric layer and barrier ribs.

Table 3 shows that baking temperatures ranging from 560° C. to 570° C. offer an improved adhesive strength between the dielectric layer and the barrier ribs.

EXAMPLES 7 TO 9

Rear substrate structures were fabricated in substantially the same manner as in Example 1 except the following points. Example 7 employed a barrier rib material layer containing 1 wt % to 2 wt % of a cellulosic resin. Example 8 employed a barrier rib material layer containing 2 wt % to 4 wt % of the cellulosic resin. Example 9 employed a barrier rib material layer comprising three layers having a thickness ratio of 1:13:1, i.e., an upper layer and a lower layer each containing 2 wt % to 4 wt % of the cellulosic resin and an intermediate layer containing 1 wt % to 2 wt % of the cellulosic resin.

The results are shown in Table 4, in which the processing time and the adhesive strength were evaluated on the basis of those in Example 7 regarded as 1 for comparison. The evaluation of the adhesive strength was based on a time taken before the barrier ribs were peeled off when a predetermined load was applied to the barrier ribs.

TABLE 4

| | Processing time | Adhesive strength |
|---|---|---|
| Ex. 7 | 1 | 1 |
| Ex. 8 | 4 | 3 |
| Ex. 9 | 1.1 | 4 |

Table 4 shows that the adhesive strength can efficiently be improved by properly adjusting the content of the cellulosic resin.

EXAMPLES 10 TO 15

Rear substrate structures were fabricated in substantially the same manner as in Example 1, except that aqueous solutions as shown in Table 5 were used for the removal of the mask. The results are shown in Table 5.

TABLE 5

| | Solution for removal | Concentration | Evaluation |
|---|---|---|---|
| Ex. 10 | Sodium carbonate | 0.1 wt % | OK |
| Ex. 11 | Sodium carbonate | 0.5 wt % | OK |
| Ex. 12 | Sodium carbonate | 1.0 wt % | OK |
| Ex. 13 | Sodium carbonate | 2.0 wt % | NG |
| Ex. 14 | Sodium hydroxide | 0.1 wt % | NG |
| Ex. 15 | Sodium hydroxide | 0.2 wt % | NG |

As can be seen from Table 5, it is preferred to use as the solution for the mask removal a weak alkaline aqueous solution containing sodium carbonate, particularly, in a concentration of 0.1 wt % to 1.0 wt %.

EXAMPLE 16

A rear substrate structure was fabricated in substantially the same manner as in Example 1, except that a barrier rib material layer containing fillers with particle diameters of 4 μm to 6 μm and of 1 μm to 2 μm in proportions of 15 wt % to 25 wt % and 3 wt % to 7 wt %, respectively, was used and the baking temperature was 575° C. to 580° C.

The resulting barrier ribs were free from separation and from the slow leak of a discharge gas.

COMPARATIVE EXAMPLE 8

A rear substrate structure was fabricated in substantially the same manner as in Example 1, except that a barrier rib material layer containing fillers with particle diameters of 1 μm to 2 μm and of 2 μm to 3 μm in proportions of 5 wt % to 10 wt % and 6 wt % to 10 wt %, respectively, was used and the baking temperature was 560° C. to 570° C.

About 30% of the resulting barrier ribs were peeled off.

EXAMPLE 17

Fluorescent layers were formed between the ribs of the rear substrate structure fabricated in Example 16 by a screen printing method.

ITO was deposited to a thickness of 1,000 Å on a front glass substrate and patterned for formation of sustain electrodes (width: 180 μm, pitch: 80 μm) . Then, Cr, Cu and Cr were deposited thereon in this order to thicknesses of 1,000 Å, 10,000 Å and 2,000 Å, respectively, and patterned for formation of bus electrodes (width: 70 μm, alternate pitch: 220 μm). In turn, a dielectric layer of a low melting point glass having a thickness of 28 μm was formed on the entire surface of the resulting front substrate. Further, a protective film of MgO having a thickness of 6,000 Å was formed on the dielectric layer. Thus, the front substrate structure was completed.

Subsequently, the rear substrate structure and the front substrate structure were joined together with the address electrodes arranged perpendicular to the sustain electrodes and the bus electrodes, and the periphery of the substrates was sealed. Thus, a PDP as shown in FIGS. 3 to 5 was completed. A Ne discharge gas (containing 4 vol % of Xe) was charged into a space defined between the substrates by the barrier ribs to an inner pressure of 500 Torr.

The separation of the barrier ribs did not occur during the PDP fabrication process, and the PDP was free from the slow leak of the discharge gas.

The barrier rib formation methods according to the present invention offer an increased adhesive strength between the barrier rib material layer and the barrier rib formation surface (the surface of the substrate or the dielectric layer), thereby preventing the barrier ribs from separating from the barrier rib formation surface when the mask is removed after the formation of the barrier ribs by sandblasting.

The plasma display panel according to the present invention exhibits an increased adhesive strength between the barrier ribs and the dielectric layer. Therefore, the barrier ribs can be prevented from separating from the dielectric layer due to an external force applied when the panel is assembled (or the substrate structures are joined together).

What is claimed is:

1. A method of forming barrier ribs for a plasma display panel comprising the steps of:

roughening a barrier rib formation surface of a substrate;

forming a barrier rib material layer on the roughened barrier rib formation surface;

forming on the barrier rib material layer a mask having a pattern corresponding to the barrier ribs to be formed;

partially removing the barrier rib material layer by blasting an abrasive against the barrier rib material layer to form the barrier ribs below the mask; and removing the mask, thereby barrier ribs for partitioning a discharge space form on the substrate.

2. A method as set forth in claim 1, wherein the roughened barrier rib formation surface is a microscopically undulated surface having a surface roughness of 4 μm to 6 μm.

3. A method as set forth in claim 1, wherein the barrier rib formation surface is roughened by a sandblasting method or a chemical etching method.

4. A method as set forth in claim 1, wherein the barrier rib material layer comprises at least two layers including a first barrier rib material layer containing 2 wt % to 4 wt % of a cellulosic resin and a second barrier rib material layer containing 1 wt % to 2 wt % of the cellulosic resin on the first barrier rib material layer.

5. A method as set forth in claim 1, wherein the mask is removed by using a weak alkaline aqueous solution.

6. A method as set forth in claim 5, wherein the weak alkaline aqueous solution is an aqueous solution of sodium carbonate.

7. A barrier rib formation method for a plasma display panel comprising the steps of:

forming a dielectric layer for covering a surface of a substrate formed with a plurality of electrodes; comprising the steps of:

roughening a surface of the dielectric layer;

forming a barrier rib material layer on the roughened surface of the dielectric layer;

forming on the barrier rib material layer a mask having a pattern corresponding to barrier ribs to be formed;

partially removing the barrier rib material layer by blasting an abrasive against the barrier rib material layer to form the barrier ribs below the mask; and removing the mask, thereby barrier ribs for partitioning a discharge space form on the substrate.

8. A method as set forth in claim 7, wherein the roughened surface of the dielectric layer is a microscopically undulated surface having a surface roughness of 4 μm to 6 μm.

9. A method as set forth in claim 7, wherein the dielectric layer is formed by baking a low melting point glass paste containing low melting point glass powder and a resin binder at a temperature lower by 10 to 20° C. than a vitrification point of the low melting point glass powder.

10. A method as set forth in claim 7, wherein the dielectric layer is formed by baking a low melting point glass paste containing low melting point glass powder, a resin binder, and 6 wt % to 18 wt % of fillers having a mean particle diameter of 1.5 μm to 5 μm and free from particles having particle diameters of not greater than 1 μm.

11. A method as set forth in claim 7, wherein the dielectric layer is formed by baking a low melting point glass paste containing low melting point glass powder, a resin binder and 10 wt % to 35 wt % of fillers having a mean particle diameter of 4 μm to 10 μm.

12. A method as set forth in claim 7, wherein the dielectric layer is formed by baking a low melting point glass paste at about 575° C. to about 595° C.

13. A method as set forth in claim 7, wherein the barrier rib material layer comprises at least two layers including a first barrier rib material layer containing 2 wt % to 4 wt % of a cellulosic resin and a second barrier rib material layer containing 1 wt % to 2 wt % of the cellulosic resin on the first barrier rib material layer.

14. A method as set forth in claim 7, wherein the mask is removed by using a weak alkaline aqueous solution.

15. A method as set forth in claim 14, wherein the weak alkaline aqueous solution is an aqueous solution of sodium carbonate.

16. A plasma display panel comprising:

a plurality of electrodes formed on a surface of a substrate;

a dielectric layer covering the electrodes and having a microscopically undulated surface with a surface roughness of 4 $\mu$m to 6 $\mu$m; and the barrier ribs having a predetermined pattern and being formed for partitioning a discharge space such that walls thereof extend generally perpendicular to the surface of the substrate, by forming a barrier rib material layer on the surface of the dielectric layer, covering the barrier rib material layer with a mask having a predetermined pattern, and removing a portion of the barrier rib material layer exposed from the mask by sandblasting.

* * * * *